US012228130B2

(12) United States Patent
Seol et al.

(10) Patent No.: US 12,228,130 B2
(45) Date of Patent: Feb. 18, 2025

(54) ROTARY COMPRESSOR

(71) Applicant: LG ELECTRONICS INC., Seoul (KR)

(72) Inventors: Seseok Seol, Seoul (KR); Joonhong Park, Seoul (KR); Kiyoul Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/610,425

(22) Filed: Mar. 20, 2024

(65) Prior Publication Data

US 2024/0328420 A1 Oct. 3, 2024

(30) Foreign Application Priority Data

Mar. 27, 2023 (KR) ..... 10-2023-0039949

(51) Int. Cl.
*F04C 18/356* (2006.01)

(52) U.S. Cl.
CPC ..... *F04C 18/356* (2013.01); *F04C 2240/30* (2013.01)

(58) Field of Classification Search
CPC ... F04C 18/356; F04C 2240/30; F04C 18/344
USPC ..... 418/63
See application file for complete search history.

(56) References Cited

U.S. PATENT DOCUMENTS 3,900,277 A * 8/1975 Newton ..... F04C 29/12 418/184
4,021,166 A * 5/1977 Glanvall ..... F04C 18/344 418/236
9,399,993 B2 * 7/2016 Sekiya ..... F04C 29/025
10,451,070 B2 * 10/2019 Wang ..... F04C 15/0049
2014/0369878 A1 * 12/2014 Shimaguchi ..... F04C 18/3441 418/15

(Continued)

FOREIGN PATENT DOCUMENTS

CN 115370568 11/2022
EP 2803861 B1 * 4/2019 ..... F01C 21/0836
EP 3508725 A1 * 7/2019 ..... F01C 21/0809

(Continued)

OTHER PUBLICATIONS

Extended European Search Report dated Sep. 2, 2024 issued in Application No. EP24166169.3.

*Primary Examiner* — J. Todd Newton
(74) *Attorney, Agent, or Firm* — KED & ASSOCIATES

(57) ABSTRACT

A rotary compressor provided that may include a casing, a cylinder, a roller, and at least one vane slidably inserted into the roller, and the roller may have at least one bypass passage through which spaces on both sides of a contact point based on a rotational direction of the roller communicate with each other. Through the at least one bypass passage, residual refrigerant remaining in a compression space even after a discharge stroke may be bypassed to a suction chamber, thereby minimizing the refrigerant remaining in the compression space after the discharge stroke. Also, loss due to overcompression in a residual space may be suppressed or prevented while reducing suction loss due to the introduction of overcompressed high-pressure refrigerant by the bypassing the refrigerant in the residual space toward a suction side in advance.

19 Claims, 17 Drawing Sheets

(56) References Cited

U.S. PATENT DOCUMENTS

2020/0224656 A1* 7/2020 Moon ..... F04C 18/3564

FOREIGN PATENT DOCUMENTS

| | | | | |
|---|---|---|---|---|
| EP | 3889432 | A1 * | 10/2021 | ..... F04C 18/324 |
| JP | S62-142887 | | 6/1987 | |
| JP | 2000-265984 | | 9/2000 | |
| JP | 2013-072429 | | 4/2013 | |
| KR | 10-2019-0084514 | | 7/2019 | |

* cited by examiner

ROTARY COMPRESSOR

CROSS-REFERENCE TO RELATED APPLICATION(S)

Pursuant to 35 U.S.C. § 119 (a), this application claims the benefit of the earlier filing date and the right of priority to Korean Patent Application No. 10-2023-0039949, filed in Korea on Mar. 27, 2023, the contents of which are incorporated by reference herein in their entirety.

BACKGROUND

1. Field

A concentric rotary compressor is disclosed herein.

2. Background

Rotary compressors may be classified into two types, namely, a type in which a vane is slidably inserted into a cylinder to be in contact with a roller, and another type in which a vane is slidably inserted into a roller to be in contact with a cylinder. In general, the former is called a roller eccentric rotary compressor (hereinafter, referred to as a "rotary compressor"), and the latter is referred to as a vane concentric rotary compressor (hereinafter, referred to as a "concentric rotary compressor").

As for a rotary compressor, a vane inserted in a cylinder is pulled out toward a roller by elastic force or back pressure to come into contact with an outer circumferential surface of the roller. The rotary compressor independently forms compression chambers as many as the number of vanes per revolution of the roller, and the compression chambers simultaneously perform suction, compression, and discharge strokes.

On the other hand, as for a concentric rotary compressor, a vane inserted in a roller rotates together with the roller, and is pulled out by centrifugal force and back pressure to come into contact with an inner circumferential surface of a cylinder. The concentric rotary compressor continuously forms as many compression chambers as the number of vanes per revolution of the roller, and the compression chambers sequentially perform suction, compression, and discharge strokes. Accordingly, the concentric rotary compressor has a higher compression ratio than the rotary compressor. Therefore, the concentric rotary compressor is more suitable for high pressure refrigerants, such as R32, R410a, and $CO_2$, which have low ozone depletion potential (ODP) and global warming index (GWP).

In these related art concentric rotary compressors, a contact point at which an outer circumferential surface of the roller and an inner circumferential surface of the cylinder are substantially in contact with each other is located between a discharge port and a suction port, so as to separate the discharge port and the suction port from each other. However, in the related art concentric rotary compressors, a gap is formed in a circumferential direction between the discharge port and the contact point. Due to this, a compressed refrigerant is not completely discharged in the discharge stroke, and some of the compressed refrigerant remains in a space defined between the discharge port and the contact point. This refrigerant flows back into the subsequent compression chamber to cause overcompression, thereby increasing a motor input and reducing compressor efficiency.

In addition, in the related art concentric rotary compressors, pressure on a front side of the vane is excessively increased due to the overcompression of the residual refrigerant, and chattering of the vane occurs. The chattering of the vane increases vibration noise of the vane and damages a front surface of the vane and the inner circumferential surface of the cylinder, thereby causing a risk of lowering reliability of the compressor.

Additionally, in the related art concentric rotary compressor, residual refrigerant that has passed through a discharge stroke may leak excessively toward a suction stroke, thereby heating refrigerant on the side of the suction stroke. Due to this, a specific volume of suction refrigerant may increase and an amount of suction refrigerant may decrease, which may cause suction loss, thereby lowering compressor efficiency.

In addition, the related art concentric rotary compressor had a limit in expanding a suction volume because the outer circumferential surface of the roller is formed in a circular shape. This may limit compression efficiency.

Further, in the related art concentric rotary compressors, when the discharge port is formed in the cylinder, surface pressure between the front surface of the vane passing through the discharge port and the inner circumferential surface of the cylinder is increased but is not uniform, causing wear of the front surface of the vane or the inner circumferential surface of the cylinder. In addition, as a valve accommodation groove is formed in the outer circumferential surface of the cylinder, machining of the cylinder becomes complicated and manufacturing costs increase. The valve accommodation groove may lower rigidity of the cylinder and increase the chattering of the vane, thereby further increasing vibration noise of the compressor.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a concentric rotary compressor according to exemplary embodiments disclosed herein, with reference to the accompanying drawings. The embodiments describes a structure in which a bypass passage is defined in a roller, which may be equally applied to a concentric rotary compressor in which a vane is slidably inserted into a roller. For example, the embodiments may be equally applicable not only to a concentric rotary compressor having an elliptical (hereinafter, asymmetric elliptical) cylinder, an inner circumferential surface of which has a plurality of curvatures, but also to a concentric rotary compressor having a circular cylinder, an inner circumferential surface of which has one curvature. The embodiments may also be equally applicable to a concentric rotary compressor in which a vane slot into which a vane is slidably inserted is inclined by a predetermined angle with respect to a radial direction of a roller, as well as a concentric rotary compressor in which a vane slot is formed in a radial direction of a roller. Hereinafter, an example in which an inner circumferential surface of a cylinder has an asymmetric elliptical shape and a vane slot is inclined with respect to a radial direction of a roller will be described as a representative example.

Figure 1:
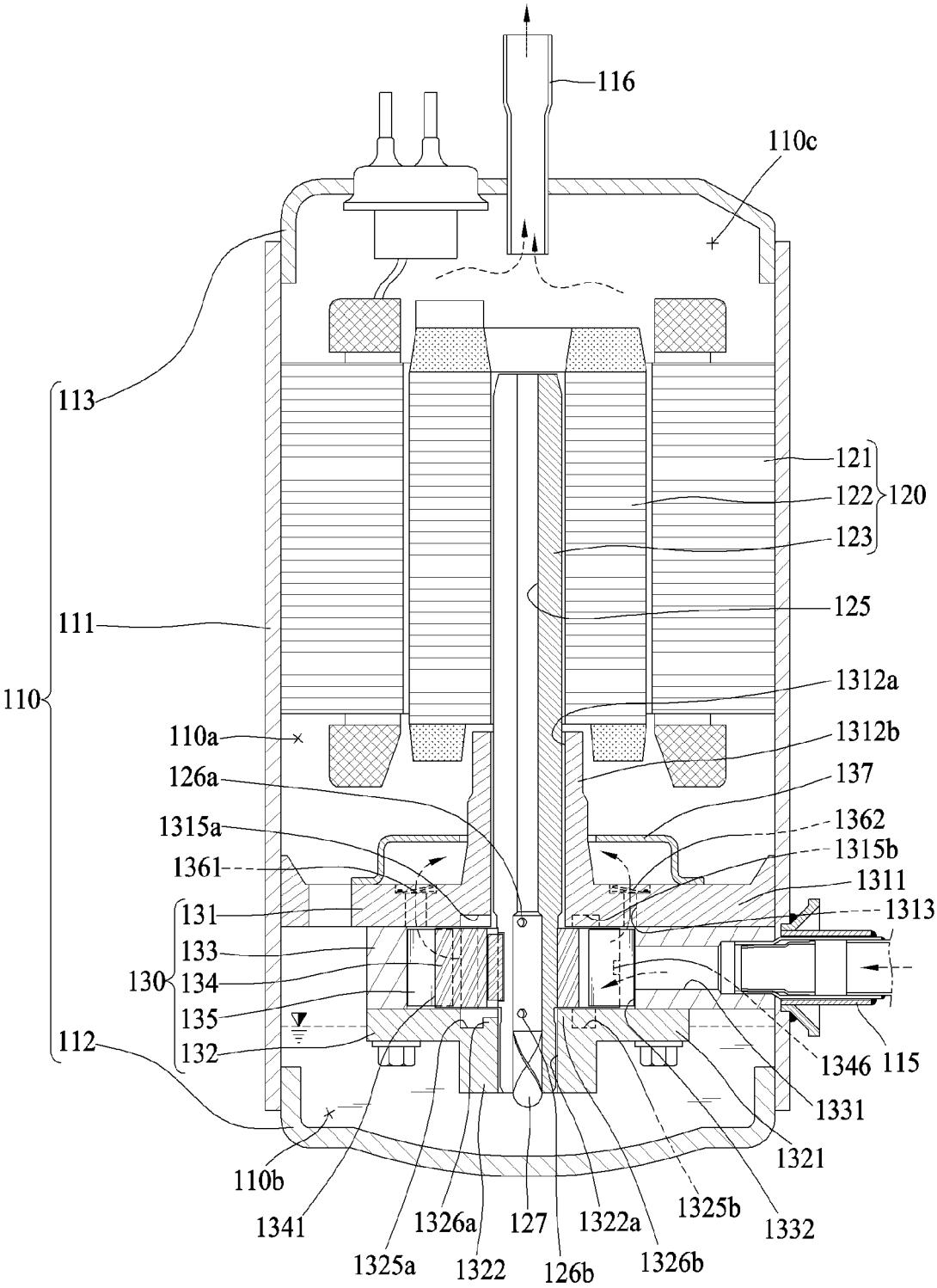
FIG. 1 is a cross-sectional view of a vane rotary compressor according to an embodiment.
Figure 2:
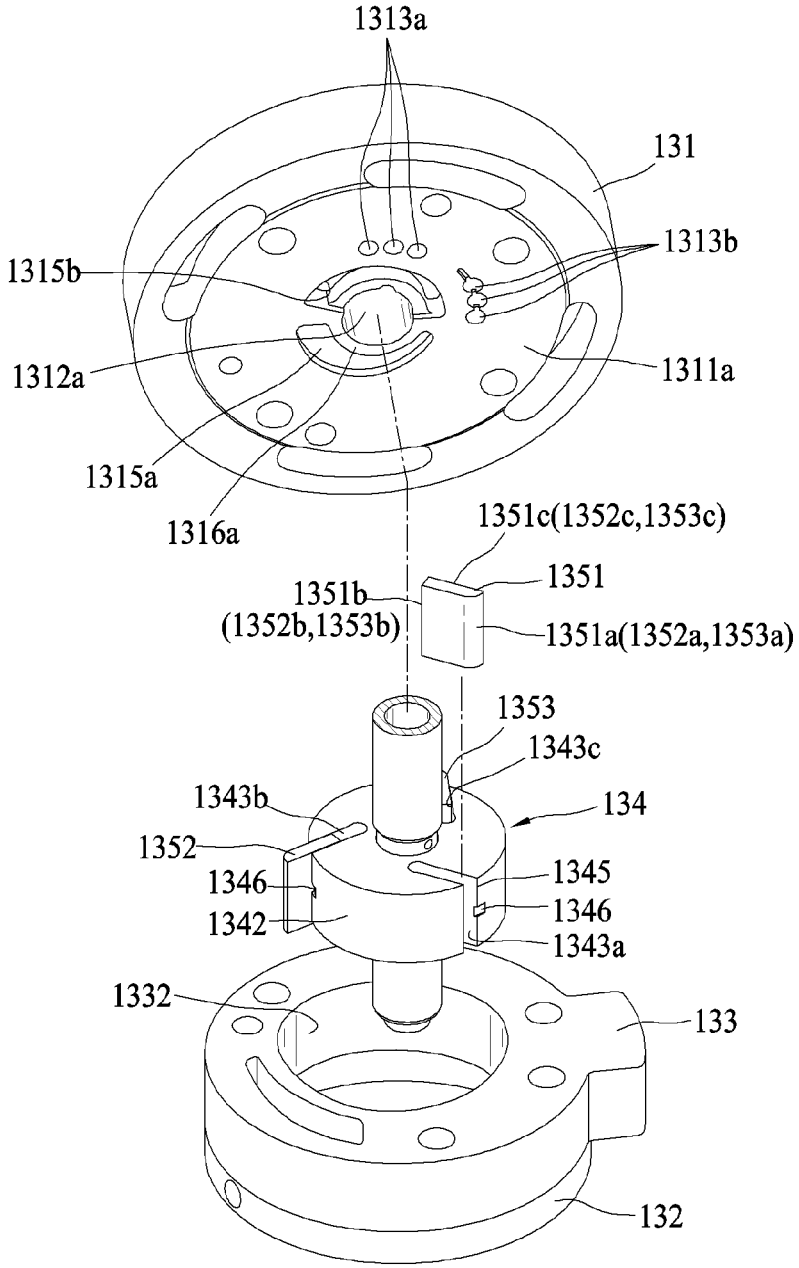
FIG. 2 is an exploded perspective view of a portion of a compression unit in FIG. 1.
Figure 3:
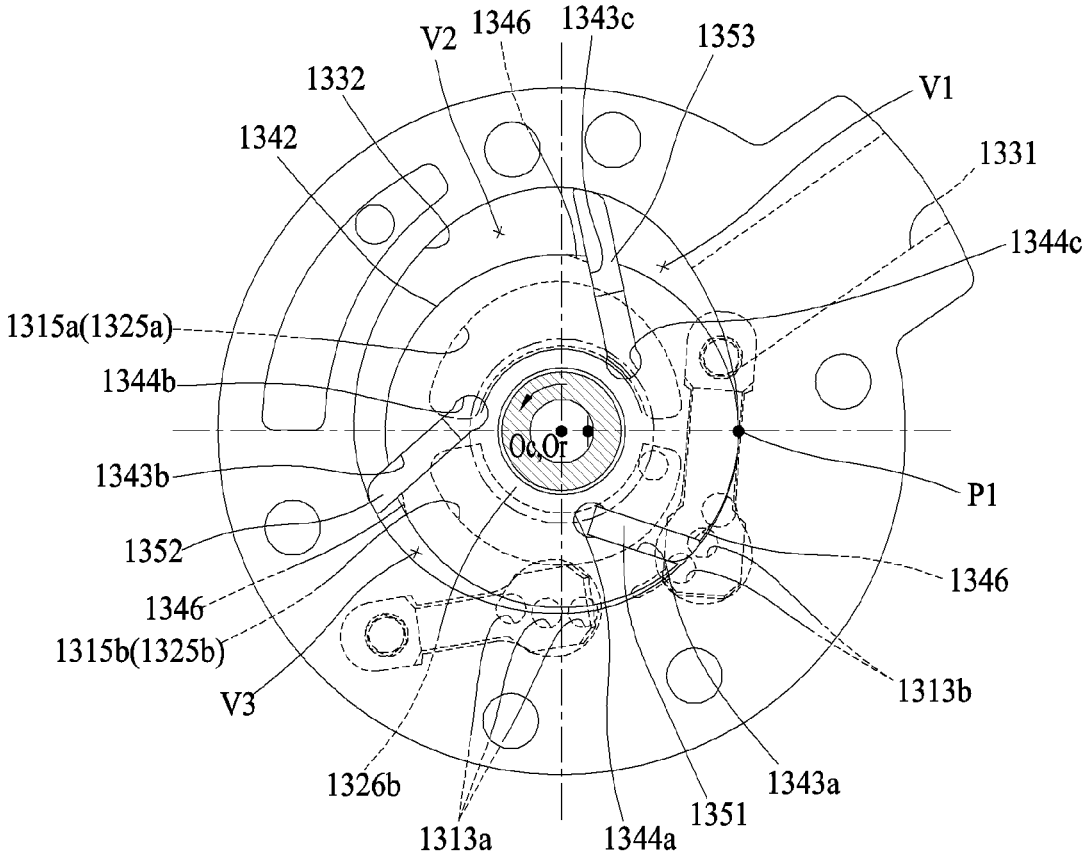
FIG. 3 is an assembled planar view of the compression unit in FIG. 2.

FIG. 1 is a cross-sectional view of a concentric rotary compressor according to an embodiment. FIG. 2 is an exploded perspective view of a compression unit in FIG. 1. FIG. 3 is an assembled planar view of the compression unit in FIG. 2.

Referring to FIG. 1, a concentric rotary compressor according to an embodiment may include a casing 110, a driving (or drive) motor 120, and a compression unit 130. The drive motor 120 may be installed in an upper inner space 110*a* of the casing 110, and the compression unit 130 may be installed in a lower inner space 110*a* of the casing 110. The drive motor 120 and the compression unit 130 may be connected through a rotational shaft 123.

The casing 110 that defines an outer appearance of the compressor may be classified as a vertical type and a horizontal type according to a compressor installation method. As for the vertical type casing, the drive motor 120 and the compression unit 130 are disposed at upper and lower sides in an axial direction, respectively. As for the horizontal type casing, the drive motor 120 and the compression unit 130 are disposed at left and right sides or lateral, respectively. The casing according to this embodiment may be illustrated as the vertical type.

The casing 110 may include an intermediate shell 111 having a cylindrical shape, a lower shell 112 that covers a lower end of the intermediate shell 111, and an upper shell 113 that covers an upper end of the intermediate shell 111.

The drive motor 120 and the compression unit 130 may be inserted into the intermediate shell 111 to be fixed thereto, and a suction pipe 115 may penetrate through the intermediate shell 111 to be directly connected to the compression unit 130. The lower shell 112 may be coupled to the lower end of the intermediate shell 111 in a sealing manner, and an oil storage space 110*b* in which oil to be supplied to the compression unit 130 is stored may be formed below the compression unit 130. The upper shell 113 may be coupled to the upper end of the intermediate shell 111 in a sealing manner, and an oil separation space 110*c* may be formed above the drive motor 120 to separate oil from refrigerant discharged from the compression unit 130.

The drive motor 120 that constitutes a motor unit supplies power to cause the compression unit 130 to be driven. The drive motor 120 may include a stator 121, a rotor 122, and the rotational shaft 123.

The stator 121 may be fixedly inserted into the casing 110. The stator 121 may be fixed to an inner circumferential surface of the casing 110 in, for example, a shrink-fitting manner. For example, the stator 121 may be press-fitted into an inner circumferential surface of the intermediate shell 111.

The rotor 122 may be rotatably inserted into the stator 121, and the rotational shaft 123 may be press-fitted into a center of the rotor 122. Accordingly, the rotational shaft 123 rotates concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bush portion 1312 described hereinafter and second oil passage hole 126*b* belonging to a range of a sub bush portion 1322. Each of the first oil passage hole 126*a* and the second oil passage hole 126*b* may be provided as one or as a plurality. In this embodiment, each of the first and second oil passage holes is provided as a plurality.

An oil pickup 127 may be installed in or at a middle or lower end of the oil passage 125. A gear pump, a viscous pump, or a centrifugal pump may be used for the oil pickup 127, for example. This embodiment illustrates a case in which the centrifugal pump is employed. Accordingly, when the rotational shaft 123 rotates, oil filled in the oil storage space 110*b* is pumped by the oil pickup 127 and is suctioned along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

The rotational shaft 123 may include a roller 134 described hereinafter. The roller 134 may extend integrally from the rotational shaft 123 or the rotational shaft 123 and the roller 134 that are separately manufactured may be post-assembled to each other. In this embodiment, the rotational shaft 123 is post-assembled by being inserted into the roller 134. For example, a shaft hole 1341 may be, for example, formed through a center of the roller 134 in an axial direction and the rotational shaft 123 may be press-fitted into the shaft hole 1341 or coupled to the shaft hole 1341 to be movable in the axial direction. When the rotational shaft 123 is movably coupled to the roller 134 in the axial direction, a rotation preventing unit (not illustrated) may be provided between the rotational shaft 123 and the roller 134 so that the rotational shaft 123 may be locked with respect to the roller 134 in the circumferential direction.

The compression unit 130 may include a main bearing 131, a sub bearing 132, a cylinder 133, a roller 134, and a plurality of vanes 1351, 1352, and 1353. The main bearing 131 and the sub bearing 132 may be respectively provided at upper and lower parts or portions of the cylinder 133 to define a compression space V together with the cylinder 133, the roller 134 rotatably installed in the compression space V, and the vanes 1351, 1352, and 1353 slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 may define an upper surface of the compression space V, and support an upper surface of the roller 134 in the axial direction while supporting an upper-half portion of the rotational shaft 123 in the radial direction.

The main bearing 131 may include a main plate portion 1311 and a main bush portion 1312. The main plate portion 1311 may cover an upper part or portion of the cylinder 133 to be coupled thereto, and the main bush portion 1312 may axially extend from a center of the main plate portion 1311 toward the drive motor 120 so as to support the upper portion of the rotational shaft 123.

The main plate portion 1311 may have a disk shape, and an outer circumferential surface of the main plate portion 1311 may be fixed to an inner circumferential surface of the intermediate shell 111 in a close contact manner. At least one discharge port 1313*a*, 1313*b* may be disposed in the main plate portion 1311, and a plurality of discharge valves 1361, 1362 may be disposed in an upper surface of the main plate portion 1311 to open and close each discharge port 1313*a*, 1313*b*. Accordingly, the structure of the cylinder 133 may be simplified and the cylinder may be easily machined. In addition, surface pressure between front surface 1351*a*, 1352*a*, 1353*a* of the vane 1351, 1352, 1353 in the vicinity of the discharge port 1313*a*, 1313*b* and inner circumferential surface 1332 of the cylinder 133 facing it may be lowered and constantly maintained at the same time, while chattering of the vane 1351, 1352, 1353 may be reduced so as to suppress or prevent wear and vibration noise between the front surface of the vane 1351, 1352, 1353 and the inner circumferential surface of the cylinder 133.

A first main back pressure pocket 1315*a* and a second main back pressure pocket 1315*b* may be formed in a lower surface, namely, a main sliding surface 1311*a* of the main plate portion 1311, facing an upper surface of the roller 134, of both axial side surfaces of the main plate portion 1311. A first main bearing protrusion 1316*a* may be formed on an inner circumferential surface of the first main back pressure pocket 1315*a* at a same height as the main sliding surface 1311*a*, and an inner circumferential surface of the second main back pressure pocket 1315*b* may be open. Accordingly, the first main back pressure pocket 1315*a* may form low intermediate pressure while the second main back pressure pocket 1315*b* may form high intermediate pressure (or discharge pressure).

A main bearing hole 1312*a* having a hollow shape may be formed in the main bush portion 1312, and a main bearing surface 1312*b* may be formed on an inner circumferential surface of the main bearing hole 1312*a* to support the rotational shaft 123 in the radial direction. Accordingly, the upper half portion of the rotational shaft 123, that is, an upper side of the roller 134, which will be described hereinafter, may be supported in the radial direction by the main bearing 131.

Referring to FIGS. 1 to 3, the sub bearing 132 may be coupled to a lower end of the cylinder 133 in a close contact manner. Accordingly, the sub bearing 132 may define a lower surface of the compression space V, and support a lower surface of the roller 134 in the axial direction while supporting a lower-half portion of the rotational shaft 123 in the radial direction.

The sub bearing 132 may include a sub plate potion 1321 and the sub bush portion 1322. The sub plate portion 1321 may cover a lower part or portion of the cylinder 133 to be coupled to thereto, and the sub bush portion 1322 may axially extend from a center of the sub plate portion 1321 toward the lower shell 112 so as to support the lower portion of the rotational shaft 123.

The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed on an upper surface, namely, a sub sliding surface 1321*a* of the sub plate portion 1321 facing the lower surface of the roller 134, of both axial side surfaces of the sub plate portion 1321.

The first sub back pressure pocket 1325*a* and the second sub back pressure pocket 1325*b* may be symmetric to the first main back pressure pocket 1315*a* and the second main back pressure pocket 1315*b*, respectively, with respect to the roller 134. For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other.

A first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*. The first sub bearing protrusion 1326*a* may be formed to be flush with a sub sliding surface, and the second sub bearing protrusion 1326*b* may be formed lower than the sub sliding surface. Accordingly, the first sub back pressure pocket 1325*a* may form low intermediate pressure like the first main back pressure pocket 1315*a*, and the second sub back pressure pocket 1325*b* may form high intermediate pressure (or discharge pressure) like the second main back pressure pocket 1315*b*.

A sub bearing hole 1322*a* having a hollow shape may be formed in the sub bush portion 1322, and a sub bearing surface 1325*b* may be formed on an inner circumferential surface of the sub bearing hole 1322*a* to support the rotational shaft 123 in the radial direction. Accordingly, the lower half portion of the rotational shaft 123, that is, the lower side of the roller 134, which will be described hereinafter, may be supported in the radial direction by the sub bearing 132.

The discharge port 1313 may be provided as a plurality 1313*a*, 1313*b* that are disposed at a preset or predetermined interval along a compression proceeding direction (or a rotational direction of the roller). Accordingly, a discharge area may be secured as wide as possible even if a gap between the inner circumferential surface 1332 of the cylinder 133 and the outer circumferential surface 1342 of the roller 134 is narrowed near contact point P1.

Referring to FIGS. 1 to 3, the cylinder 133 according to this embodiment may be in close contact with the lower surface of the main bearing 131 and coupled to the main bearing 131 by, for example, a bolt together with the sub bearing 132. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 that penetrates from an outer circumferential surface to an inner circumferential surface thereof. However, the suction port may alternatively be formed through the main bearing 131 or the sub bearing 132. This embodiment illustrates an example in which suction port 1331 is formed through the cylinder 133.

The suction port 1331 may be formed at one or a first side of the contact point P1 described hereinafter in the circumferential direction. The discharge port 1313 described above may be formed through the main bearing 131 at another or a second side of the contact point P1 in the circumferential direction that is opposite to the suction port 1331.

The inner circumferential surface 1332 of the cylinder 133 may be formed in an elliptical shape. The inner circumferential surface 1332 of the cylinder 133 according to this embodiment may be formed in an asymmetric elliptical shape in which a plurality of ellipses, for example, four ellipses having different major and minor ratios are combined to have two origins.

Referring to FIGS. 1 to 3, the roller 134 according to this embodiment may be rotatably disposed in the compression space V of the cylinder 133, and the plurality of vanes 1351, 1352, 1353 described hereinafter may be inserted in the roller 134 at predetermined intervals along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 are three, and thus, the compression space V is partitioned into three compression chambers V1, V2, and V3.

As described above, the roller 134 may extend integrally from the rotational shaft 123 or may be manufactured separately from the rotational shaft 123 and then post-assembled to the rotational shaft 123. This embodiment will be described based on an example in which the roller 134 is post-assembled to the rotational shaft 123.

However, even when the roller 134 extends integrally from the rotational shaft 123, the rotational shaft 123 and the roller 134 may be formed similarly to those in this embodiment, and the basic operating effects thereof may also be substantially the same as those of this embodiment. However, when the roller 134 is post-assembled to the rotational shaft 123 as in this embodiment, the roller 134 may be formed of a material different from the rotational shaft 123, for example, a material lighter than that of the rotational shaft 123. This may facilitate processing of the roller body 134, and simultaneously reduce a weight of a rotating body including the roller 134, thereby enhancing efficiency of the compressor.

The roller 134 according to this embodiment may be formed as a single body, that is, an integral roller having one roller body (no reference numeral). However, the roller 134 may not be necessarily formed as the integral roller. For example, the roller 134 may be formed as a separable roller that is separated into a plurality of roller bodies (no reference numeral).

Referring to FIGS. 1 to 3, the roller 134 according to this embodiment may be formed in an annular shape with a shaft hole 1341 at a center thereof. For example, the roller 134 may have inner and outer circumferential surfaces, and the inner and outer circumferential surfaces of the roller 134 may be formed in a circular shape. However, the inner circumferential surface of the roller 134 may be formed as a continuous seamless surface, whereas the outer circumferential surface of the roller 134 may be formed by discontinuous surfaces which are as many as the number of vane slots 1343*a* because of open surfaces of the vane slots 1343*a*, 1343*b*, 1343*c*, which will be described hereinafter.

The roller 134 may have the plurality of vane slots 1343*a*, 1343*b*, and 1343*c*, into which the vanes 1351, 1352, and 1353 described hereinafter are slidably inserted, respectively. The plurality of vane slots 1343*a*, 1343*b*, and 1343*c* may be formed at preset or predetermined intervals along the circumferential direction. The outer circumferential surface 1342 of the roller 134 may have open surfaces that are open in the radial direction. Back pressure chambers 1344*a*, 1344*b*, and 1344*c*, which will be described hereinafter, may be formed in inner end portions that are opposite to the open surfaces, so as to have a closed shape in the radial direction.

The back pressure chamber 1344*a*, 1344*b*, 1344*c* may be hermetically sealed by the main bearing 131 and the sub bearing 132. The back pressure chambers 1344*a*, 1344*b*, and 1344*c* may independently communicate with each of the back pressure pockets [1315*a*, and 1315*b*], [1325*a*, and 1325*b*], and may also communicate with each other through the back pressure pockets [1315*a*, and 1315*b*], and [1325*a*, and 1325*b*].

The plurality of vane slots 1343*a*, 1343*b*, and 1343*c* described above may be formed in the outer circumferential surface 1342 of the roller 134, and a bypass passage 1346 described hereinafter may be formed in an upstream edge (discharge-side edge or first edge) 1345, based on the rotational direction of the roller 134, of both edges where both inner surfaces forming each vane slot 1343*a*, 1343*b*, 1343*c* meet the outer circumferential surface 1342 of the roller 134. Accordingly, refrigerant in a residual space S, which will be described hereinafter, may be bypassed to a suction stroke-side compression chamber (hereinafter, referred to as a suction chamber) Vs through the bypass passage 1346, suppressing or preventing chattering of the vane 1351, 1352, 1353. The bypass passage 1346 will be described again hereinafter.

Also, a rotational center Or of the roller 134 may be coaxially located with an axial center (no reference numeral) of the rotational shaft 123, and the roller 134 rotate concentrically with the rotational shaft 123. However, as described above, as the inner circumferential surface 1332 of the cylinder 133 is formed in the asymmetric elliptical shape biased in a specific direction, the rotational center Or of the roller 134 may be eccentrically disposed with respect to an outer diameter center Oc of the cylinder 133. Accordingly, one side of the outer circumferential surface 1342 of the roller 134 may be almost brought into contact with the inner circumferential surface 1332 of the cylinder 133, thereby defining the contact point P.

Referring to FIGS. 1 to 3, a plurality of vanes 1351, 1352, and 1353 according to this embodiment may be slidably inserted into the respective vane slots 1343*a*, 1343*b*, and 1343*c*. Accordingly, the plurality of vanes 1351, 1352, and 1353 may have substantially a same shape as the respective vane slots 1343*a*, 1343*b*, and 1343*c*.

For example, the plurality of vanes 1351, 1352, 1353 may be defined as first vane 1351, second vane 1352, and third vane 1353 along the rotational direction of the roller 134. The first vane 1351 may be inserted into the first vane slot 1343*a*, the second vane 1352 into the second vane slot 1343*b*, and the third vane 1353 into the third vane slot 1343*c*, respectively.

The plurality of vanes 1351, 1352, and 1353 may have substantially the same shape. For example, the plurality of vanes 1351, 1352, and 1353 may each be formed in a substantially rectangular parallelepiped shape, and the front surfaces 1351*a*, 1352*a*, 1353*a* of the vanes 1351, 1352, and 1353 in contact with the inner circumferential surface 1332 of the cylinder 133 may be curved in the circumferential direction. Accordingly, the front surfaces 1351*a*, 1352*a*, and 1353*a* of the vanes 1351, 1352, and 1353 may come into line-contact with the inner circumferential surface 1332 of the cylinder 133, thereby reducing friction loss.

In the drawings, unexplained reference numeral 137 denotes a discharge muffler.

Hereinafter, operation of the concentric rotary compressor with the hybrid cylinder will be described.

That is, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. The plurality of vanes 1351, 1352, and 1353 may be drawn out of the vane slots 1343*a*, 1343*b*, and 1343*c* by centrifugal force generated by the rotation of the roller 134 and back pressure of the back pressure chambers 1344*a*, 1344*b*, and 1344*c*, which support the rear surfaces 1351*b*, 1352*b*, 1353*b* of the vanes 1351, 1352, and 1353, thereby being brought into contact with the inner circumferential surface 1332 of the cylinder 133.

The compression space V of the cylinder 133 may be partitioned by the plurality of vanes 1351, 1352, and 1353 into as many compression chambers (including suction chamber or discharge chamber) V1, V2, and V3 as the number of the vanes 1351, 1352, and 1353. The compression chambers V1, V2, and V3 may be changed in volume by the shape of the inner circumferential surface 1332 of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes are repeatedly carried out.

As a distance between the inner circumferential surface 1332 of the cylinder 133 and the outer circumferential surface 1322 of the roller 134 is sharply narrowed approaching the contact point P1, the second discharge port 1313*b*, which is the final discharge port, is located at a predetermined distance from the contact point P1 in the circumferential direction. Accordingly, a residual space S is defined between the second discharge port 1313*b*, which is the final discharge port, and the contact point P1, and refrigerant which has not been discharged even through the second discharge port 1313*b* remains in the residual space S. As described above, this may cause wear and abnormal noise due to chattering of the vane as well as overcompression in the residual space S, which may reduce compression efficiency.

Accordingly, in this embodiment, the bypass passage 1346 for discharging refrigerant remaining in the residual space S may be formed in the outer circumferential surface 1342 of the roller 134 defining a part or portion of the residual space S. Accordingly, the residual space S may be periodically open toward the suction chamber-side compression space (that is, suction chamber) Vs by the bypass passage 1346, which may suppress or prevent high-pressure refrigerant, which has not been discharged from the residual space S, from remaining in the residual space S or minimize such residual refrigerant. This may enhance compression efficiency by suppressing or preventing overcompression of the refrigerant as well as chattering of the vane 1351, 1352, 1353.

Figure 4:
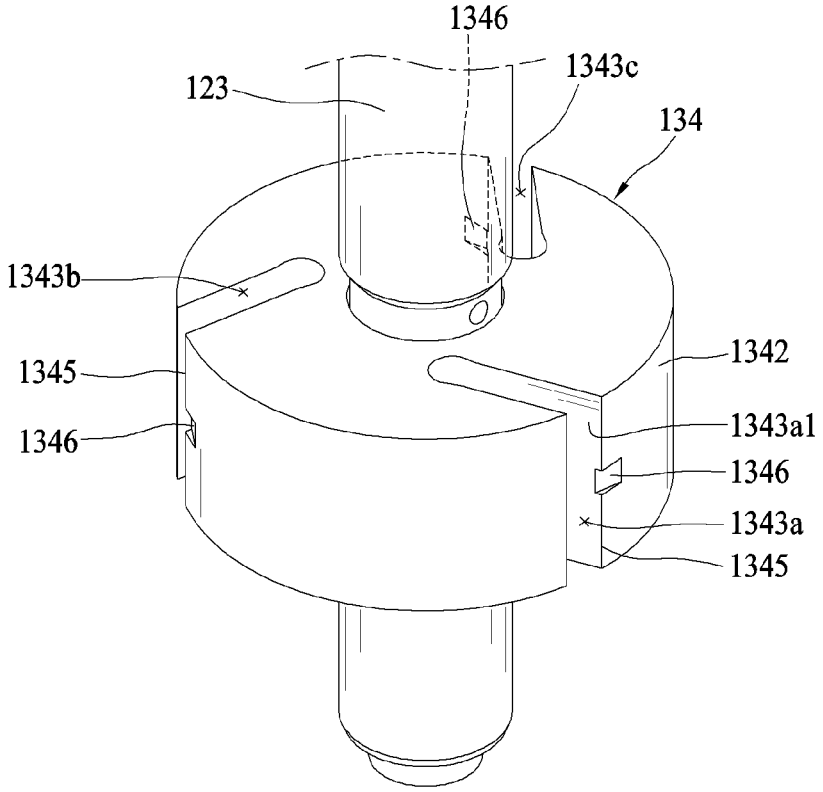
FIG. 4 is a perspective view of a roller in FIG. 1.
Figure 5:
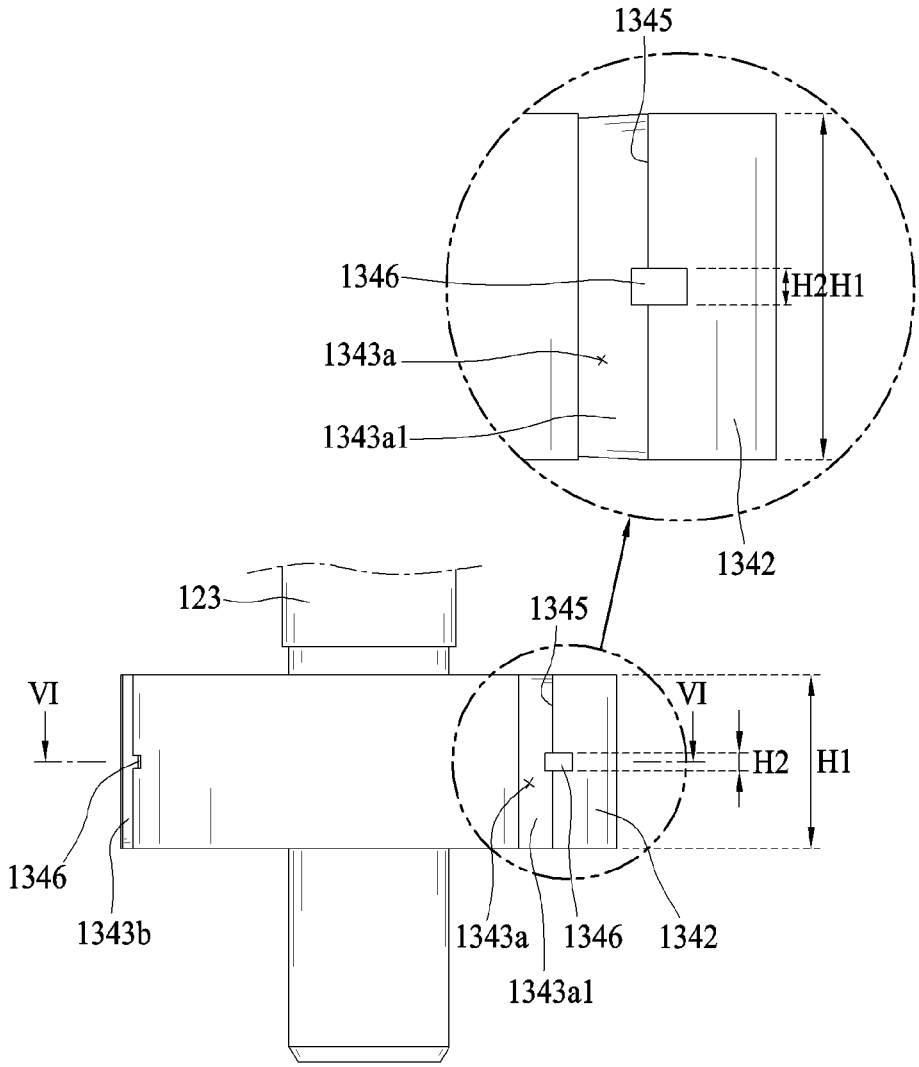
FIG. 5 is a front view of the roller of FIG. 4.
Figure 6:
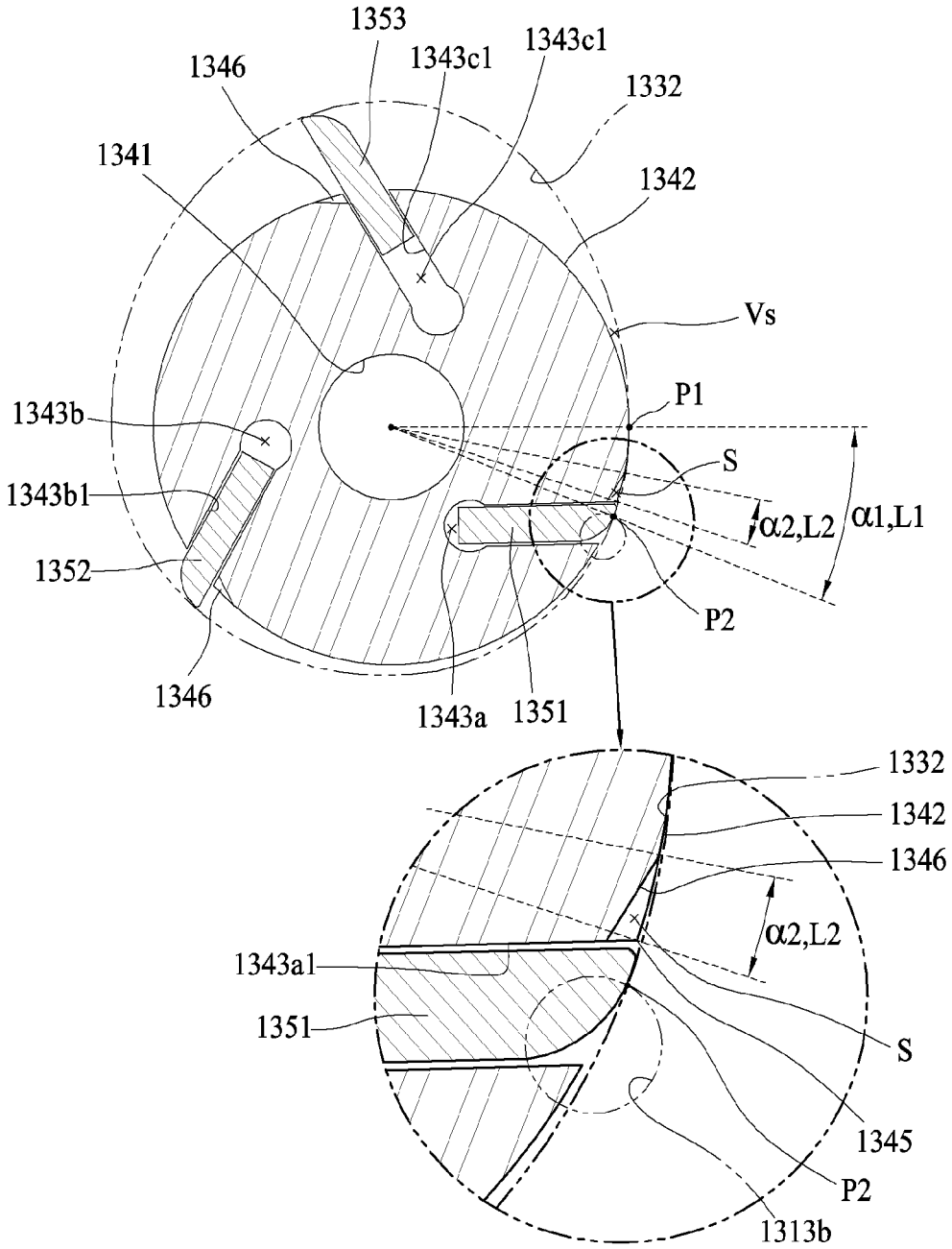
FIG. 6 is a cross-sectional view, taken along line "VI-VI" of FIG. 5.

FIG. 4 is a perspective view of a roller in FIG. 1. FIG. 5 is a front view of the roller of FIG. 4. FIG. 6 is a cross-sectional view, taken along line "VI-VI" of FIG. 5. FIGS. 7A to 7D are schematic views of a process of discharging residual refrigerant through a bypass passage in accordance with an embodiment.

Referring to FIGS. 1 to 3, in the rotary compressor according to this embodiment, the inner circumferential surface 1332 of the cylinder 133 forming the compression space V may be formed in an asymmetric shape by the combination of a plurality of ellipses. The roller 134 coupled to the rotational shaft 123 may be eccentrically disposed such that one point of the outer circumferential surface 1342 of the roller 134 is in contact with the inner circumferential surface 1332 of the cylinder 133. The plurality of vanes 1351, 1352, 1353 may be slid into the plurality of vane slots 1343*a*, 1343*b*, 1343*c*, respectively, which are disposed along the outer circumferential surface 1342 of the roller 134. Accordingly, each of the vanes 1351, 1352, and 1353 may be brought into contact with the inner circumferential surface 1332 of the cylinder 133 by the centrifugal force generated during rotation of the roller 134 and back pressure of the back pressure chamber 1344*a*, 1344*b*, 1344*c* disposed inside of the vane slot 1343*a*, 1343*b*, 1343*c*, and may divide the compression space V into the plurality of compression chambers V1, V2, V3, such that refrigerant is suctioned, compressed, and discharged.

In this case, the residual space S may be defined by the compression surface 1351*c*, 1352*c*, 1353*c* of the vane 1351, 1352, 1353 passing through the contact point P1, the outer circumferential surface 1342 of the roller 134 facing it, and the inner circumferential surface 1332 of the cylinder 133, such that non-discharged refrigerant remains therein. The refrigerant in the residual space S may be bypassed to the neighboring compression chamber (suction chamber) Vs through the bypass passage 1346 disposed in the outer circumferential surface 1342 of the roller 134, thereby lowering pressure of the residual space S.

Referring to FIGS. 4 to 6, the bypass passage 1346 according to this embodiment may be formed in the outer circumferential surface 1342 of the roller 134. For example, the roller 134 may have the plurality of vane slots 1343*a*, 1343*b*, 1343*c* each formed at a preset or predetermined angle and recessed by a preset or predetermined depth into the outer circumferential surface 1342 of the roller 134. Accordingly, each of the vane slots 1343*a*, 1343*b*, 1343*c* may have both inner surfaces spaced apart from each other in the rotational direction of the roller 134, to support the compression space of the vane 1351, 1352, 1353 and a back pressure surface (no reference numeral) opposite to the compression surface.

The bypass passage 1346 may be formed at an upstream edge (hereinafter, referred to as a first edge) 1345, at which an inner surface in the rotational direction of the roller 134 of both inner surfaces of the vane slot 1343*a*, 1343*b*, 1343*c*, that is, first inner surface 1343*a*1, 1343*b*1, 1343*c*1 facing the compression surface 1351*c*, 1352*c*, 1353*c* of the vane 1351, 1352, 1353 meets the outer circumferential surface 1342 of the roller 134. For example, the bypass passage 1346 may be recessed at the first edge 1345 by a preset or predetermined depth. Accordingly, one or a first end of the bypass passage 1346 may communicate with the outer circumferential surface 1342 of the roller 134, and another or a second end of the bypass passage 1346 may communicate with the first inner surface 1343*a*1, 1343*b*1, 1343*c*1 of the vane slot 1343*a*, 1343*b*, 1343*c*.

Referring to FIGS. 4 and 5, the bypass passage 1346 may be formed only on a portion of the first edge 1345 of the vane slot 1343*a*, 1343*b*, 1343*c*. For example, the bypass passage 1346 may have an axial length H2 which is less than half of an axial length H1 of the roller 134. In other words, a communication area between the residual space S and the suction chamber Vs forming both spaces with respect to the contact point P1 may be smaller than or equal to a blocking area. With this configuration, excessive introduction of refrigerant of the residual space S into the suction chamber V2 may be suppressed or prevented, resulting in suppressing or preventing refrigerant of the suction chamber V2 from being heated by the refrigerant introduced from the residual space S. This may appropriately lower the pressure of the residual space S to suppress or prevent an increase in specific volume of suction refrigerant, as well as chattering of the vane 1351, 1352, 1353. This may particularly be advantageous for a small rotary compressor having a small suction volume.

The bypass passage 1346 may be formed to be located at a center of the first edge 1345 in the axial direction. Accordingly, pressure on both sides of the residual space S in the axial direction may be maintained uniformly, so that the behavior of the vane 1351, 1352, 1353 may be stabilized.

Referring to FIG. 6, an angle $\alpha 2$ between both ends of the bypass passage 1346 may be smaller than or equal to an angle a1 between the contact point P1 and discharge completion point P2 of the vane 1351, 1352, and 1353. In other words, an arcuate length L2 of the bypass passage 1346 may be smaller than or equal to an arcuate length L1 between the center of the front surface of the vane 1351, 1352, 1353 in contact with the inner circumferential surface 1332 of the cylinder 133 and the contact point P1 in a state in which the corresponding vane 1351, 1352, 1353 is located at the discharge completion point P2. This may suppress or prevent the bypass passage 1346 from communicating with another compression chamber (that is, suction chamber) Vs neighboring to the corresponding compression chamber V1, V2, V3 before the discharge stroke of the compression chamber V1, V2, V3 is completed.

In addition, the arcuate length L2 of the bypass passage 1346 may be smaller than or equal to a circumferential width D1 of the vane slot 1343*a*, 1343*b*, 1343*c*. This may suppress the bypass passage 1346 from being excessively long, so as to more effectively prevent the bypass passage 1346 from communicating with another compression chamber (that is, suction chamber) V2 neighboring to the corresponding compression chamber V1, V2, V3 before the discharge stroke of the compression chamber V1, V2, V3 is completed.

Hereinafter, operating effects of the rotary compressor according to this embodiment will be described.

Referring back to FIG. 3, as the vane 1351, 1352, 1353 rotates together with the roller 134, the corresponding compression chamber V1, V2, V3 sequentially passes through the discharge ports 1313*a*, 1313*b*. At this time, most of refrigerant compressed in the corresponding compression chamber V1, V2, V3 is discharged into the inner space 110*a* of the casing 110 through each discharge port 1313*a*, 1313*b*. However, the refrigerant partially remains in the corresponding compression chamber V1, V2, V3 without being discharged through the second discharge port 1313*b*. As a result, liquid refrigerant or oil remains in a mixed state in the residual space S between the discharge port 1313*b* and the contact point P1.

However, in this embodiment, the roller 134 has the bypass passage 1346 through which the residual space S communicates with the suction-side space (suction chamber) Vs. Therefore, the residual space S may periodically communicate with the suction chamber V. Accordingly, the refrigerant remaining in the residual space S may partially be periodically bypassed to the neighboring compression chamber (that is, suction chamber). This may suppress or minimize or prevent blocking of high-pressure refrigerant in the residual space S, thereby reducing a pressure difference between front and rear sides of the corresponding vane 1351, 1352, 1353.

FIGS. 7A to 7D are schematic views of a process of discharging residual refrigerant through a bypass passage in accordance with an embodiment. In these drawings, a case in which the second discharge port is the final discharge port is exemplarily illustrated, but the final discharge port may change depending on the number of discharge ports.

Figure 7A:
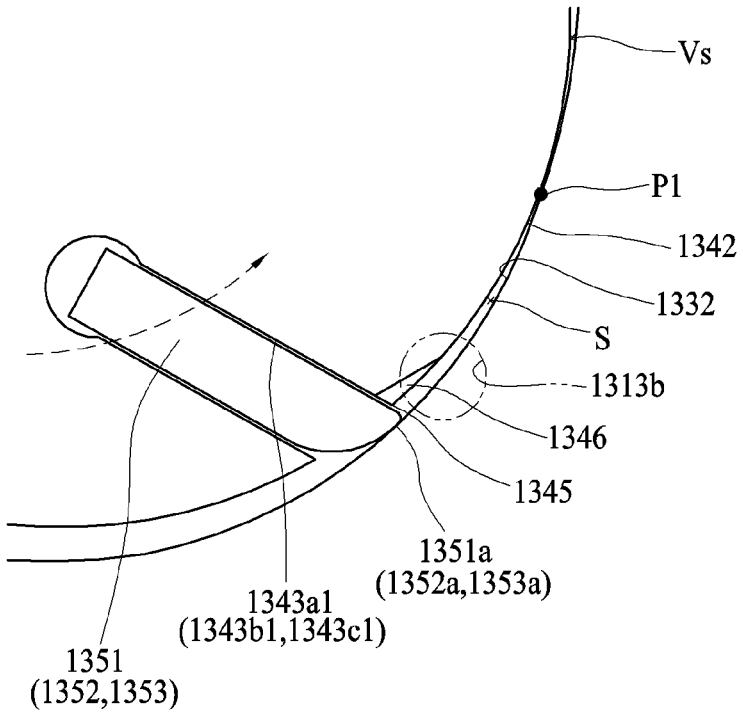
FIGS. 7A to 7D are schematic views of a process of discharging residual refrigerant through a bypass passage in accordance with an embodiment.

FIG. 7A illustrates a state in which the corresponding vane 1351, 1352, 1353 has arrived at a position adjacent to the second discharge port 1313*b*, in response to the rotation of the roller 134. In this state, the vane 1351, 1352, 1353 is still in the course of passing through the second discharge port 1313*b*. Therefore, the second discharge port 1313*b* is still open, and accordingly, the residual space S communicating with the second discharge port 1313*b* is kept open toward the second discharge port 1313*b* without being sealed. Then, refrigerant in the residual space S is discharged, together with refrigerant of the corresponding compression chamber V1, V2, V3, into the inner space 110*a* of the casing 110 through the second discharge port 1313*b* before the corresponding vane 1351, 1352, 1353 passes through the second discharge port 1313*b*.

Figure 7B:
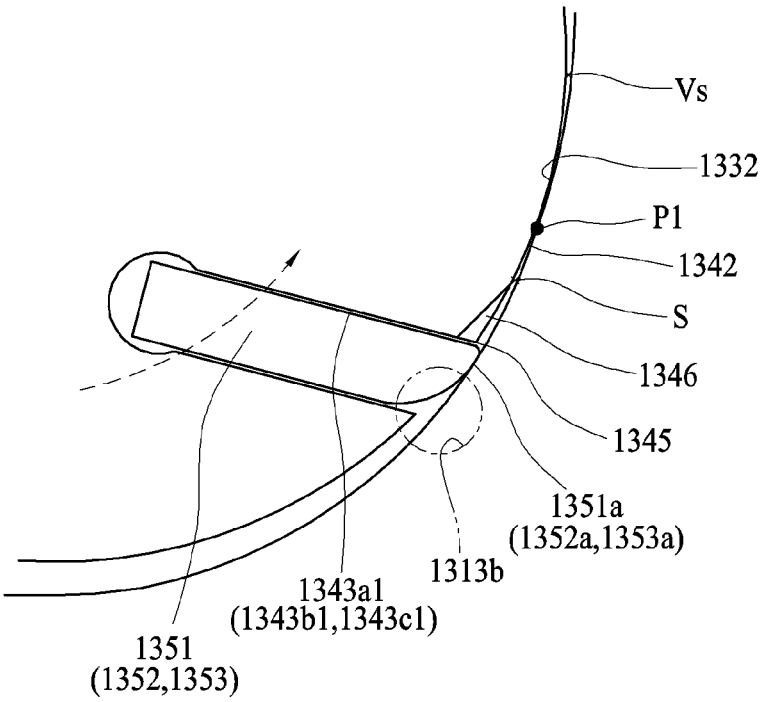

FIG. 7B illustrates a state in which the corresponding vane 1351, 1352, 1353 has just passed through the second discharge port 1313*b*, in response to further rotation of the roller 134. In this state, the corresponding vane 1351, 1352, 1353 is located between the second discharge port 1313*b* and the residual space S, and the residual space S is sealed with being separated from the second discharge port 1313*b*. At this time, the bypass passage 1346 disposed in the roller 134 is in a state before communicating with the neighboring compression chamber (that is, suction chamber) Vs. Accordingly, the refrigerant in the residual space S remains in the residual space S without being bypassed to the neighboring compression chamber (that is, suction chamber) Vs. However, in this case, as the pressure in the residual space S has not reached its maximum value, chattering of the vane 1351, 1352, 1353 due to the residual refrigerant is not increased.

Figure 7C:
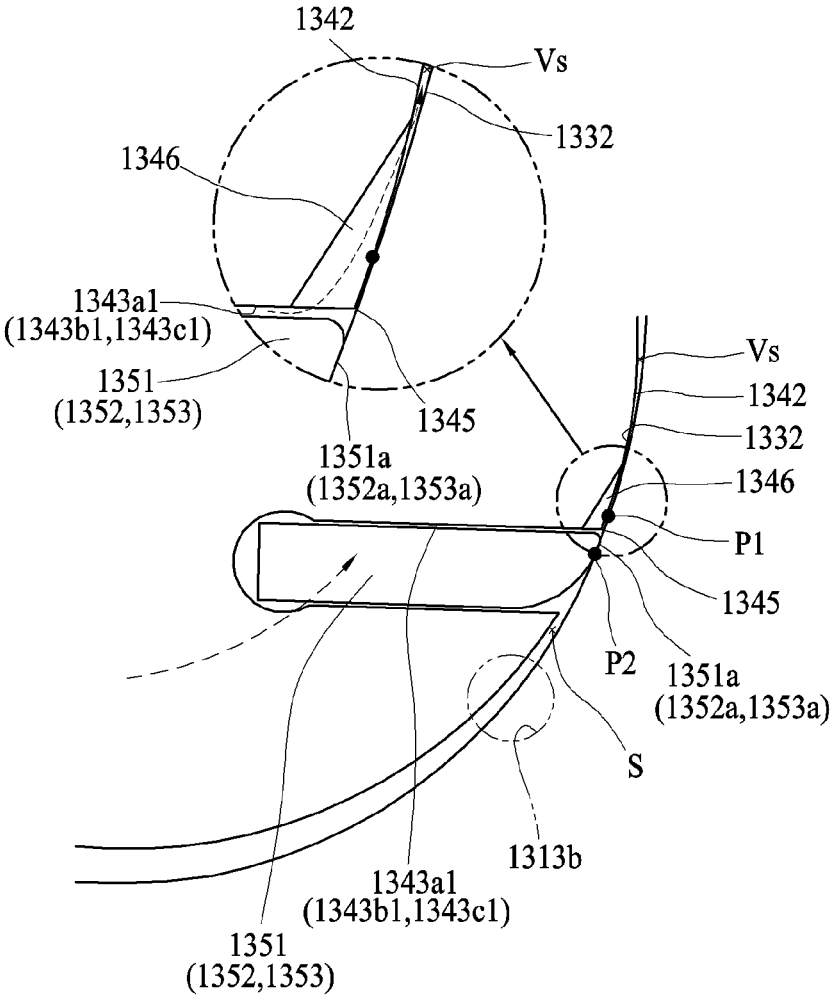

FIG. 7C illustrates a state in which the corresponding vane 1351, 1352, 1353 has arrived at a position between a final position (that is, discharge completion reach point) of the second discharge port 1313*b* and the contact point P1. In this state, the upstream end of the bypass passage 1346 passes through the contact point P1 to communicate with the neighboring compression chamber (that is, suction chamber), so that the residual space S is open toward the neighboring compression chamber (that is, suction chamber). Accordingly, the refrigerant in the residual space S is bypassed to the neighboring compression chamber (that is, suction chamber) through the bypass passage 1346 before the pressure of the residual space S increases excessively. This may suppress or prevent an excessive increase in pressure difference between front and rear sides of the corresponding vane 1351, 1352, 1353, thereby preventing chatting of the vane 1351, 1352, 1353. In addition, the residual refrigerant excessively compressed in the residual space S may be prevented in advance from being introduced into the suction chamber V2, resulting in suppressing or preventing an excessive increase in specific volume of suction refrigerant.

Figure 7D:
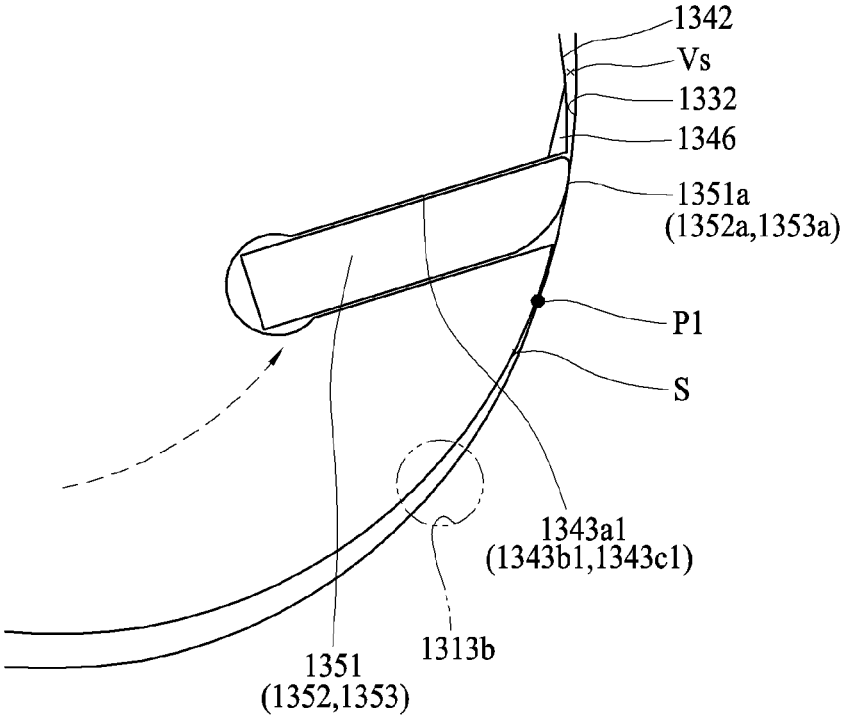

FIG. 7D illustrates a state in which the corresponding vane 1351, 1352, 1353 has completely passed through the contact point P1, in response to further rotation of the roller 134. In this state, the bypass passage 1346 is closed and the two neighboring compression chambers, that is, the compression chamber V in the course of the compression stroke and the compression chamber (that is, suction chamber) Vs in the course of the suction stroke are blocked from each other. Accordingly, the residual space S may periodically communicate with the suction chamber V2 and regular communication between the compression chambers through the bypass passage 1346 may be prevented, thereby suppressing or preventing compression efficiency from being lowered.

In this way, residual refrigerant remaining in the compression space may be bypassed to the suction chamber through the bypass passage even after the discharge stroke, thereby minimizing the refrigerant remaining in the compression space even after the discharge stroke. In addition, as the bypass passage is periodically open, leakage of refrigerant to the compression chamber of low pressure may be suppressed or prevented during the compression stroke, resulting in preventing an occurrence of under-compression.

In addition, high-pressure refrigerant may be suppressed or prevented from remaining in the residual space and accordingly pressure acting on the front surface of the vane may be equalized, which may result in resolving a difference between pressure acting on the front surface of the vane and pressure acting on the rear surface, thereby suppressing or preventing jumping of the vane. This may also prevent the front surface of the vane or the inner circumferential surface of the cylinder facing the front surface from being worn out and simultaneously reduce vibration noise due to chattering of the vane.

Additionally, with the suppression of high-pressure refrigerant from remaining in the residual space, an excessive increase in pressure in the residual space can be suppressed. In this way, a loss due to overcompression in the compression chamber may be suppressed or prevented. Further, as the refrigerant in the remaining space is bypassed to the suction side in advance, overcompressed high-pressure refrigerant may be suppressed or prevented from flowing toward a suction side over the contact point, thereby reducing a suction loss.

Those effects described above may be achieved more easily in the rotary compressor according to this embodiment when a high-pressure refrigerant, such as R32, R410a, or $CO_2$ is used.

Hereinafter, description will be given of a bypass passage according to another embodiment. That is, in the previous embodiment, the single bypass passage is formed in the center of the first edge corresponding to the upstream-side or discharge-side edge of the vane slot, but in some cases, a plurality of bypass passages may be formed in both sides of the first edge in the axial direction.

Figure 8:
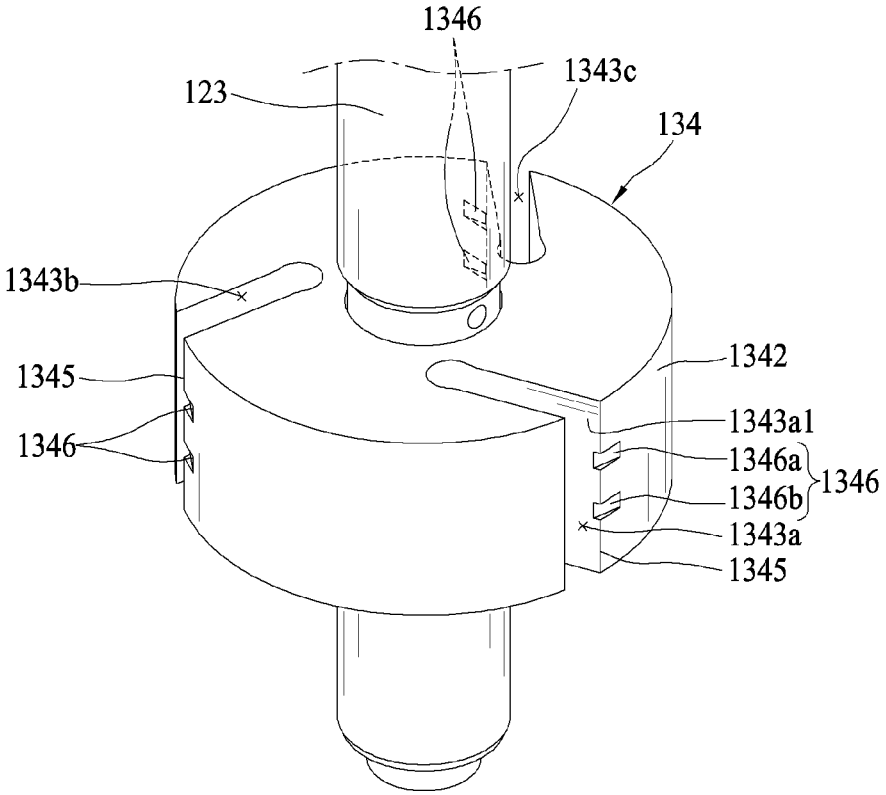
FIG. 8 is a perspective view of a roller with a bypass passage according to another embodiment.
Figure 9:
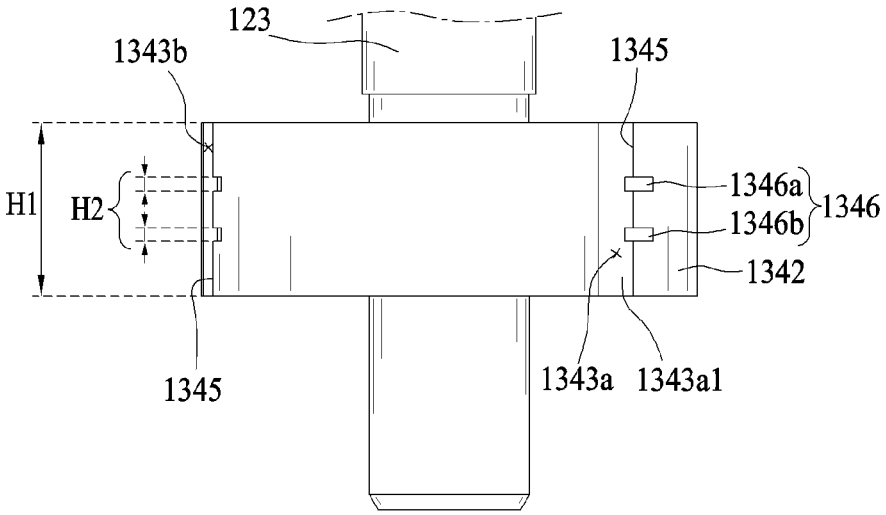
FIG. 9 is a front view of the roller of FIG. 8.

FIG. 8 is a perspective view of a roller with a bypass passage according to another embodiment. FIG. 9 is a front view of the roller of FIG. 8.

Referring back to FIGS. 1 to 3, the main bearing 131, the sub bearing 132, the cylinder 133, the roller 134, and the vanes 1351, 1352, 1353 which constitute the compression unit 130 according to this embodiment may be formed almost the same as those of the previous embodiment. In other words, the main bearing 131 and the sub bearing 132 may be coupled to both sides of the cylinder 133 in the axial direction to form the compression space V, the cylinder may be in contact with the roller 134 at one point (contact point) P1 to divide the compression space V into a plurality of spaces, and at least one vane slot 1343*a*, 1343*b*, 1343*c* may be disposed in the roller 134. Each vane slot 1343*a*, 1343*b*, 1343*c* may be open toward the outer circumferential surface 1342 of the roller 134, and the vane 1351, 1352, 1353 may be slidably inserted into the vane slot 1343*a*, 1343*b*, 1343*c*, dividing the compression space V into the plurality of compression chambers V1, V2, V3.

In addition, according to this embodiment, bypass passage 1346 may be formed in one side edge of the vane slot 1343*a*, 1343*b*, 1343*c*, for example, a first edge (upstream-side edge or discharge-side edge) 1345, which faces the compression surface 1351*c*, 1352*c*, 1353*c* of the vane 1351, 1352, 1353 in the circumferential direction. In other words, the bypass passage 1346, through which spaces on both sides of the contact point P1, for example, the residual space S and the suction space communicate with each other when each vane slot 1343*a*, 1343*b*, 1343*c* passes near the contact point P1, may be formed in the first edge 1345 of the vane slot 1343*a*, 1343*b*, 1343*c*. Accordingly, some of refrigerant, which remains in the residual space S without being discharged through the discharge port 1313*a*, 1313*b*, of refrigerant compressed in the respective compression chambers V1, V2, V3, may be bypassed to the suction chamber Vs through the bypass passage 1346 before the residual space S passes through the contact point P1. With this structure, an excessive increase in pressure of the residual space S may be suppressed or prevented, solving the overcompression of the residual space S in advance while preventing or reducing chattering of the vane. The specific shape, including the arcuate length or cross-sectional area of the bypass passage 1346, the location of the bypass passage 1346, and the resulting effects are the same or almost the same as those in the previous embodiment, and thus, detailed description thereof will be replaced by the description of the previous embodiment.

However, referring to FIGS. 8 and 9, in this embodiment, each bypass passage 1346 may be provided as a plurality, which are disposed in the first edge 1345 at a preset or predetermined interval along the axial direction, and may be formed to be symmetrical with each other based on the center of the first edge 1345. For example, an upper bypass passage 1346*a* formed in or at an upper half of the first edge 1345 and a lower bypass passage 1346*b* formed in or at a lower half of the first edge 1345 may be located at positions spaced a same interval apart from the center of the first edge 1345 in the axial direction, and may have a same cross-sectional area. Accordingly, refrigerant in the remaining space S may be evenly distributed through the upper bypass passage 1346*a* and the lower bypass passage 1346*b* and bypassed to the suction chamber Vs. With this structure, a load on the compression surface 1351*c*, 1352*c*, 1353*c* of the vane 1351, 1352, 1353 facing the residual space S may be maintained uniformly, thereby suppressing chattering of the vane more effectively.

In addition, as in the previous embodiment, a total axial length H2 of the plurality of bypass passages 1346 may be formed to be equal to or shorter than half axial length H1 of the vane slot 1343*a*, 1343*b*, 1343*c*. Accordingly, as described above, refrigerant in the remaining space S may be suppressed or prevented from being excessively bypassed to the suction chamber Vs, thereby suppressing or preventing an excessive increase in specific volume of suction refrigerant. As described above, this may be effective for a small rotary compressor with a small suction volume.

Although not illustrated in the drawings, the total axial length H2 of the plurality of bypass passages 1346 may be formed to be longer than or equal to half the axial length H1 of the vane slot 1343*a*, 1343*b*, 1343*c*. In this case, refrigerant in the residual space S may be quickly bypassed to the suction chamber Vs, thereby quickly lowering pressure in the residual space S. As described above, this may be effective for a large rotary compressor with a relatively large suction volume.

Hereinafter, description will be given of a bypass passage according to still another embodiment. That is, in the previous embodiment, the bypass passage is formed in the portion of the first edge, but in some cases, the bypass passage may be formed throughout the first edge.

Figure 10:
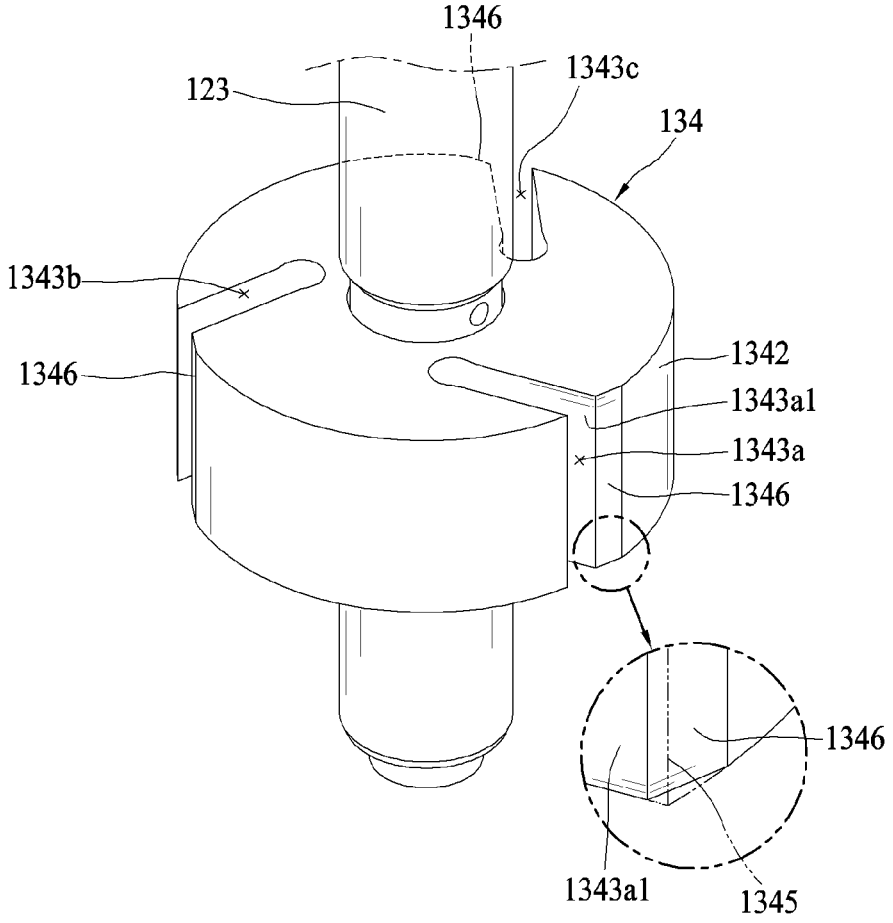
FIG. 10 is a perspective view of a roller with a bypass passage according to still another embodiment.
Figure 11:
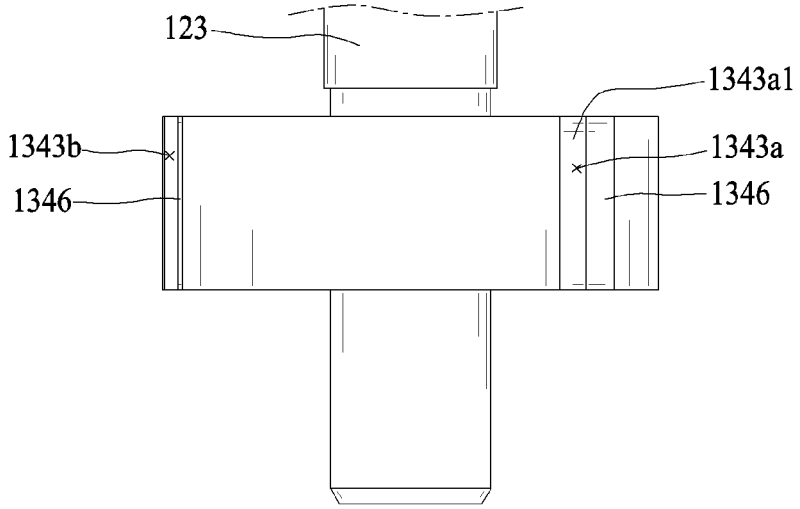
FIG. 11 is a front view of the roller of FIG. 10.

FIG. 10 is a perspective view of a roller with a bypass passage according to still another embodiment. FIG. 11 is a front view of the roller of FIG. 10.

Referring back to FIGS. 1 to 3, the main bearing 131, the sub bearing 132, the cylinder 133, the roller 134, and the vanes 1351, 1352, 1353 which constitute the compression unit according to this embodiment may be formed almost the same as those of the previous embodiment. In other words, the main bearing 131 and the sub bearing 132 may be coupled to both sides of the cylinder 133 in the axial direction to form the compression space V, the cylinder may be in contact with the roller 134 at one point (contact point) P1 to divide the compression space V into a plurality of spaces, and at least one vane slot 1343*a*, 1343*b*, 1343*c* may be disposed in the roller 134. Each vane slot 1343*a*, 1343*b*, 1343*c* may be open toward the outer circumferential surface 1342 of the roller 134, and the vane 1351, 1352, 1353 may be slidably inserted into the vane slot 1343*a*, 1343*b*, 1343*c*, dividing the compression space V into the plurality of compression chambers V1, V2, V3.

In addition, according to this embodiment, the bypass passage 1346 may be formed in one side edge of the vane slot 1343*a*, 1343*b*, 1343*c*, for example, the first edge (upstream-side edge or discharge-side edge) 1345, which faces the compression surface 1351*c*, 1352*c*, 1353*c* of the vane 1351, 1352, 1353 in the circumferential direction. In other words, the bypass passage 1346, through which spaces on both sides of the contact point P1, for example, the residual space S and the suction chamber Vs communicate with each other when each vane slot 1343*a*, 1343*b*, 1343*c* passes near the contact point P1, may be formed in the first edge 1345 of each vane slot 1343*a*, 1343*b*, 1343*c*. Accordingly, some of refrigerant, which remains in the residual space S without being discharged through the discharge port 1313*b*, of refrigerants compressed in the respective compression chambers V1, V2, V3, may be bypassed to the suction chamber Vs through the bypass passage 1346 before the residual space S passes through the contact point P1. With this structure, an excessive increase in pressure of the residual space S may be suppressed or prevented, solving the overcompression of the residual space S in advance while preventing or reducing chattering of the vane. The specific shape, including the arcuate length or cross-sectional area of the bypass passage 1346, the location, specification, and the resulting effects are the same or almost the same as those in the previous embodiment, and thus, detailed description thereof will be replaced by the description of the previous embodiment.

However, referring to FIGS. 10 and 11, in this embodiment, the bypass passage 1346 may be formed by chamfering the first edge 1345 between both ends in the axial direction of the first edge 1345. In other words, the bypass passage 1346 may be formed along the first edge 1345 from one or a first axial end of the first edge 1345 to another or a second axial end of the first edge 1345. In this case, the bypass passage 1346 may be formed with a same shape and cross-sectional area along the axial direction. Accordingly, the cross-sectional area of the bypass passage 1346 may be large, allowing refrigerant in the residual space S to be quickly bypassed to the suction chamber Vs. This may quickly lower pressure of the residual space S to suppress or prevent chattering the vane 1351, 1352, 1353 more effectively. As described above, this may be effective for a large rotary compressor with a relatively large suction volume.

Hereinafter, description will be given of a bypass passage according to still another embodiment. That is, in the previous embodiment, the bypass passage is recessed into the first edge, but in some cases, the bypass passage may be formed through the first edge.

Figure 12:
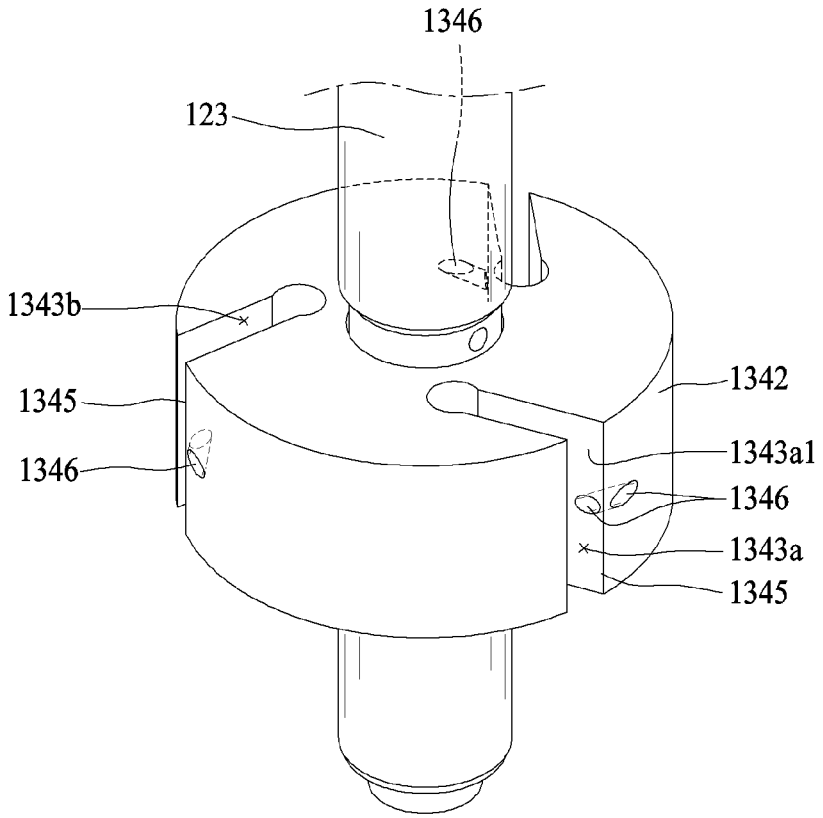
FIG. 12 is a perspective view of a roller with a bypass passage according to still another embodiment.
Figure 13:
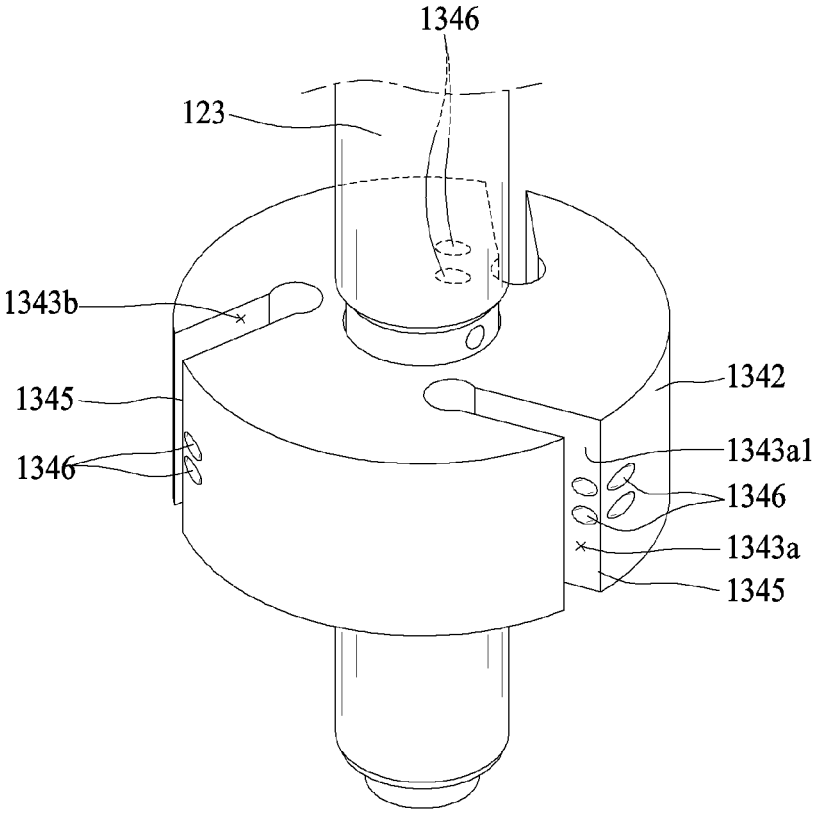
FIG. 13 is a perspective view of a roller with a bypass passage according to still another embodiment.
Figure 14:
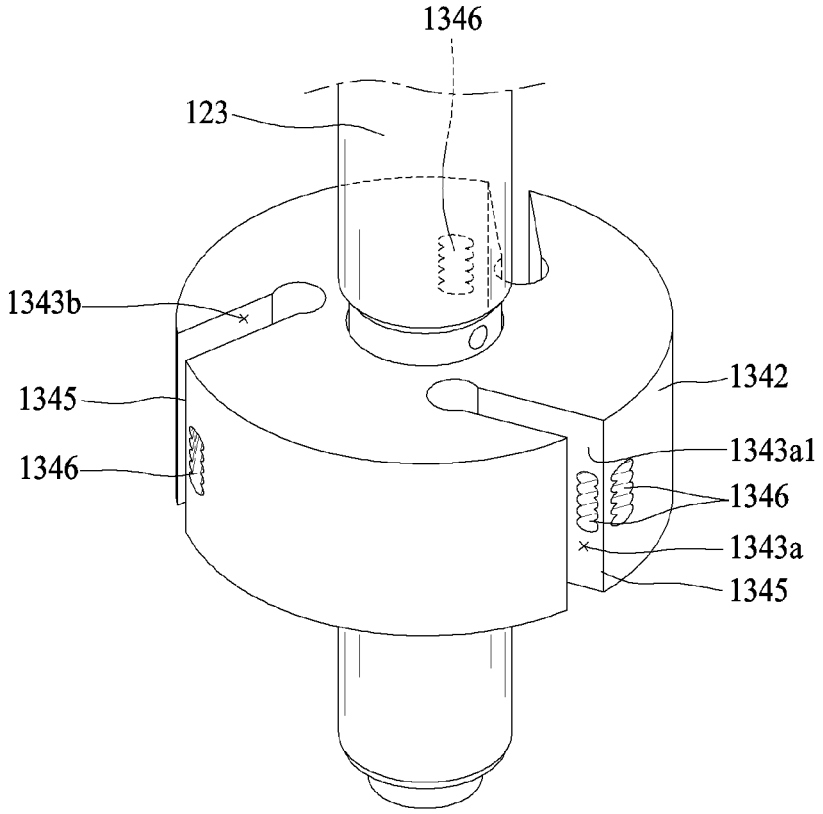
FIG. 14 is a perspective view of a roller with a bypass passage according to still another embodiment.

FIG. 12 is a perspective view of a roller with a bypass passage according to still another embodiment. FIG. 13 is a perspective view of a roller with a bypass passage according to still another embodiment. FIG. 14 is a perspective view of a roller with a bypass passage according to still another embodiment.

Referring back to FIGS. 1 to 3, the main bearing 131, the sub bearing 132, the cylinder 133, the roller 134, and the vanes 1351, 1352, 1353 which constitute the compression unit 130 according to this embodiment may be formed almost the same as those of the previous embodiment. In other words, the main bearing 131 and the sub bearing 132 may be coupled to both sides of the cylinder 133 in the axial direction to form the compression space V, the cylinder 133 may be in contact with the roller 134 at one point (contact point) P1 to divide the compression space V into a plurality of spaces, and at least one vane slot 1343*a*, 1343*b*, 1343*c* may be disposed in the roller 134. Each vane slot 1343*a*, 1343*b*, 1343*c* may be open toward the outer circumferential surface 1342 of the roller 134, and the vane 1351, 1352, 1353 may be slidably inserted into the vane slot 1343*a*, 1343*b*, 1343*c*, dividing the compression space V into the plurality of compression chambers V1, V2, V3.

In addition, according to this embodiment, the bypass passage 1346 may be formed in one side edge of the vane slot 1343*a*, 1343*b*, 1343*c*, for example, the first edge (upstream-side edge or discharge-side edge) 1345, which faces the compression surface 1351*c*, 1352*c*, 1353*c* of the vane 1351, 1352, 1353 in the circumferential direction. In other words, the bypass passage 1346, through which spaces on both sides of the contact point P1, for example, the residual space S and the suction chamber Vs communicate with each other when each vane slot 1343*a*, 1343*b*, 1343*c* passes near the contact point P1, may be formed in the first edge 1345 of each vane slot 1343*a*, 1343*b*, 1343*c*. Accordingly, some of refrigerant, which remains in the residual space S without being discharged through the discharge port 1313*b*, of refrigerants compressed in the respective compression chambers V1, V2, V3, may be bypassed to the suction chamber Vs through the bypass passage 1346 before the residual space S passes through the contact point P1. With this structure, an excessive increase in pressure of the residual space S may be suppressed or prevented, solving the overcompression of the residual space S in advance while preventing or reducing chattering of the vane. The arcuate length L2 or cross-sectional area of the bypass passage 1346, location, specification, and resulting effects are the same or almost the same as those in the previous embodiment, and thus, detailed description thereof will be replaced by the description of the previous embodiment.

However, referring to FIGS. 12 to 14, the bypass passage 1346 according to this embodiment may be formed as a hole penetrating the first edge 1345. For example, one or a first end of the bypass passage 1346 may be open toward the outer circumferential surface 1342 of the roller 134, and another or a second end of the bypass passage 1346 may be open toward the inner surface 1343*a*1, 1343*b*1, 1343*c*1 of the vane slot 1343*a*, 1343*b*, 1343*c*. Accordingly, the entire first edge 1345 may come into contact with the inner circumferential surface 1332 of the cylinder 133 at the contact point P1. With this structure, surface pressure at the first edge 1345 of the roller 134 may be maintained uniformly along the axial direction, thereby suppressing or preventing wear between the outer circumferential surface 1342 of the roller 134 and the inner circumferential surface 1332 of the cylinder 133.

As illustrated in FIG. 12, the bypass passage 1346 may be formed as a single hole having a circular cross-section or a non-circular cross-section. For example, the bypass passage 1346 may have a circular cross-sectional shape and may be formed at the center of the first edge 1345. Accordingly, the bypass passage 1346 may be easily formed.

Additionally, as illustrated in FIG. 13, the bypass passage 1346 may have a circular cross-sectional shape and may be formed with a plurality of holes. For example, a plurality of holes may be formed at preset or predetermined intervals along the axial direction. In this case, the overall cross-sectional area of the bypass passage 1346 may be secured widely while making each hole small.

Additionally, as illustrated in FIG. 14, the bypass passage 1346 may be formed in the shape of a long hole in the axial direction. For example, the bypass passage 1346 may be formed in the shape of a long hole in the axial direction by connecting a plurality of holes. In this case, the bypass passage 1346 may be machined by connecting the plurality of holes while securing the overall cross-sectional area of the bypass passage 1246 to be wide. Therefore, the bypass passage 1346 may be easily formed without the need to consider the location of each hole.

Embodiments disclosed herein provide a rotary compressor capable of reducing an amount of residual refrigerant remaining in a compression space without being discharged.

Embodiments disclosed herein also provide a rotary compressor capable of preventing refrigerant from leaking out in the course of a compression stroke while reducing an amount of residual refrigerant in a compression space.

Embodiments disclosed herein further provide a rotary compressor in which a residual space periodically communicates with the inner space of a casing.

Embodiments disclosed herein further provide a rotary compressor capable of suppressing or preventing chattering of a vane by solving a difference between pressure acting on the front surface of the vane and back pressure acting on the rear surface of the vane, thereby reducing vibration noise of the compressor while suppressing or preventing wear of the vane or cylinder.

Embodiments disclosed herein also provide a rotary compressor capable of minimizing an increase in specific volume of suction refrigerant by suppressing or preventing residual refrigerant, which has passed through a discharge stroke, from excessively leaking toward a suction stroke while quickly discharging the residual refrigerant.

Embodiments disclosed herein additionally provide a rotary compressor capable of increasing a suction volume while discharging residual refrigerant at the front surface of a vane.

Embodiments disclosed herein further provide a rotary compressor capable of quickly discharging residual refrigerant even when a high-pressure refrigerant, such as R32, R410a, or $CO_2$ is used.

Embodiments disclosed herein provide a rotary compressor that may include a casing, a cylinder, a roller, and at least one vane. The cylinder may be disposed in an inner space of the casing to define a compression space. The roller may be disposed on a rotational shaft so as to be rotatable in the inner space of the cylinder and eccentric with respect to a center of the compression space to have a contact point close to an inner circumferential surface of the cylinder. The vane may be slidably inserted into at least one vane slot disposed in the roller, respectively, to be rotatable along with the roller. The roller may have a bypass passage through which spaces on both sides of the contact point based on a rotational direction of the roller periodically communicate with each other. Through the bypass passage, residual refrigerant remaining in the compression space even after a discharge stroke may be bypassed to a suction chamber, thereby minimizing the refrigerant remaining in the compression space even after the discharge stroke. Also, a loss due to overcompression in a residual space may be suppressed or prevented while reducing a suction loss due to an introduction of overcompressed high-pressure refrigerant by the bypassing the refrigerant in the residual space toward a suction side in advance.

The bypass passage may be formed at an edge or near the edge of the vane slot in a rotational direction of the roller, of both edges of the vane slot in contact with an outer circumferential surface of the roller. As the bypass passage is periodically open, leakage of refrigerant to a compression chamber forming lower pressure may can be suppressed or prevented during a compression stroke, resulting in preventing an occurrence of under-compression.

The vane slot may be provided as a plurality that are disposed at preset or predetermined intervals along the outer circumferential surface of the roller, and the bypass passage may be formed at or near an edge of each of the vane slots in the rotational direction of the roller, of both edges of the vane slot. With this configuration, high-pressure refrigerant may be suppressed or prevented from remaining in each residual space, to make pressure acting on the front surface of each vane uniform, thereby suppressing or preventing chattering of the vane.

The bypass passage may have one or first end that communicates with the outer circumferential surface of the roller and another or a second end that communicates with one side surface of the vane slot. This may minimize a length of the bypass passage, so that high-pressure refrigerant in the residual space may be quickly bypassed toward a suction chamber.

An angle between both ends of the bypass passage may be smaller than or equal to an angle between a discharge completion point of the vane and the contact point. This may suppress or prevent a compression chamber in the course of a discharge stroke from communicating with the suction chamber, thereby suppressing or preventing compression loss due to the bypass passage.

The bypass passage may be formed such that an arcuate length thereof is smaller than or equal to a circumferential width of the vane slot. This may suppress or prevent a compression chamber from communicating with a suction chamber before a corresponding vane passes through a final discharge port, thereby preventing an occurrence of a compression loss due to the bypass passage.

The bypass passage may be defined by at least one groove that is recessed by a preset or predetermined depth into an edge of the vane slot in contact with an outer circumferential surface of the roller. This may facilitate the bypass passage to be formed such that a residual space and a suction chamber may communicate with each other.

The bypass passage may be formed in a portion of the edge of the vane slot. Accordingly, refrigerant in a residual space may be suppressed or prevented from excessively flowing into a suction chamber while bypassing the refrigerant quickly to the suction chamber.

More specifically, the bypass passage may have an axial length that is shorter than or equal to half an axial length of the roller. This may make refrigerant in a residual space quickly bypassed to a suction chamber while suppressing or preventing an occurrence of a suction loss due to an excessive introduction of the refrigerant in the residual space into the suction chamber.

More specifically, the bypass passage may be formed in a center of the roller in an axial direction. Accordingly, refrigerant in a residual space may be quickly bypassed to a suction chamber while stabilizing the behavior of the vane by evenly maintaining support force on both axial ends of the vane.

More specifically, the bypass passage may be provided as a plurality disposed along an axial direction of the roller, and the plurality of bypass passages may be symmetrically formed with respect to a of the roller in the axial direction. Accordingly, refrigerant in a residual space may be more quickly bypassed to a suction chamber while stabilizing the behavior of the vane by evenly maintaining support force on both axial ends of the vane.

The bypass passage may be formed by chamfering an entire area of the edge of the vane slot between both ends of the edge. This may make refrigerant in a residual space bypassed to a suction chamber more quickly while expanding a suction volume by a volume of the bypass passage.

More specifically, the bypass passage may have a same cross-sectional area along an axial direction of the roller. Accordingly, refrigerant in a residual space may be more quickly bypassed to a suction chamber, a suction volume may be expanded by a volume of the bypass passage, and support force may be uniformly maintained on both axial ends of the vane to thus stabilize the behavior of the vane.

The bypass passage may be defined by at least one hole penetrating between an outer circumferential surface of the roller and a side surface of the vane slot. Accordingly, refrigerant in a residual space may be quickly bypassed to a suction chamber while a contact area between the roller and the cylinder at the contact point may be constantly maintained, thereby reducing wear.

The bypass passage may be defined by a plurality of holes disposed at preset or predetermined intervals along an axial direction. This may secure a cross-sectional area of the bypass passage while defining the bypass passage with the holes.

Additionally, the bypass passage may be formed such that an axial length thereof is longer than a circumferential length. This may secure an entire cross-sectional area as wide as possible while reducing a circumferential width of the bypass passage.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a cylinder that is disposed in an inner space of the casing to define a compression space;

a roller that is disposed on a rotational shaft to be rotatable in the inner space of the cylinder and eccentric with respect to a center of the compression space to have a contact point close to an inner circumferential surface of the cylinder; and at least one vane that is slidably inserted into at least one vane slot disposed in the roller, respectively, to be rotatable along with the roller, wherein the roller includes at least one bypass passage through which spaces on both sides of the contact point based on a rotational direction of the roller periodically communicate with each other and;

wherein an angle between ends of the at least one bypass passage is smaller than or equal to an angle between a discharge completion point of the at least one vane and the contact point.

2. The rotary compressor of claim 1, wherein the at least one bypass passage is formed at an edge or near the edge of the at least one vane slot in the rotational direction of the roller, of both edges of the at least one vane slot in contact with an outer circumferential surface of the roller.

3. The rotary compressor of claim 2, wherein the at least one vane slot comprises a plurality of vane slots disposed at predetermined intervals along the outer circumferential surface of the roller, and wherein the at least one bypass passage is formed at or near an edge of each of both edges of each of the plurality of vane slots in the rotational direction of the roller.

4. The rotary compressor of claim 2, wherein a first end of the at least one bypass passage communicates with the outer circumferential surface of the roller and a second end of the at least one bypass passage communicates with one side surface of the at least one vane slot.

5. The rotary compressor of claim 2, wherein an arcuate length of the at least one bypass passage is smaller than or equal to a circumferential width of the at least one vane slot.

6. The rotary compressor of claim 1, wherein an arcuate length of the at least one bypass passage is smaller than or equal to a circumferential width of the at least one vane slot.

7. The rotary compressor of claim 1, wherein the at least one bypass passage is defined by at least one groove that is recessed by a predetermined depth into an edge of the at least one vane slot in contact with an outer circumferential surface of the roller.

8. The rotary compressor of claim 7, wherein the at least one bypass passage is formed in a portion of the edge of the at least one vane slot.

9. The rotary compressor of claim 8, wherein an axial length of the at least one bypass passage is shorter than or equal to half an axial length of the roller.

10. The rotary compressor of claim 8, wherein the at least one bypass passage is formed at a center of the roller in an axial direction.

11. The rotary compressor of claim 8, wherein the at least one bypass passage comprises a plurality of bypass passages disposed along an axial direction of the roller, and wherein the plurality of bypass passages is symmetrically formed with respect to a center of the roller in the axial direction.

12. The rotary compressor of claim 7, wherein the at least one bypass passage is formed by chamfering an entire area of the edge of the at least one vane slot between ends of the edge.

13. The rotary compressor of claim 12, wherein the at least one bypass passage has a same cross-sectional area along an axial direction of the roller.

14. The rotary compressor of claim 1, wherein the at least one bypass passage is defined by at least one hole that extends between an outer circumferential surface of the roller and a side surface of the at least one vane slot.

15. The rotary compressor of claim 14, wherein the at least one bypass passage is defined by a plurality of holes disposed at predetermined intervals along an axial direction.

16. The rotary compressor of claim 14, wherein an axial length of the at least one bypass passage is longer than a circumferential length of the at least one bypass passage.

17. A rotary compressor, comprising:

a casing;

a cylinder that is disposed in an inner space of the casing to define a compression space;

a roller that is disposed on a rotational shaft to be rotatable in the inner space of the cylinder and eccentric with respect to a center of the compression space to have a contact point close to an inner circumferential surface of the cylinder; and at least one vane that is slidably inserted into at least one vane slot disposed in the roller, respectively, to be rotatable along with the roller, wherein the roller includes at least one groove or hole through which spaces on both sides of the contact point based on a rotational direction of the roller periodically communicate with each other and;

wherein an angle between ends of the at least one groove or hole is smaller than or equal to an angle between a discharge completion point of the at least one vane and the contact point.

18. The rotary compressor of claim 17, wherein the at least one groove or hole is formed at an edge or near the edge of the at least one vane slot in the rotational direction of the roller, of both edges of the at least one vane slot in contact with an outer circumferential surface of the roller.

19. The rotary compressor of claim 17, wherein the at least one groove or hole comprises a plurality of grooves or holes formed at the edge or near the edge of the at least one vane slot in the rotational direction of the roller.

* * * * *